US009527203B2

(12) United States Patent
Whalen

(10) Patent No.: US 9,527,203 B2
(45) Date of Patent: Dec. 27, 2016

(54) COLLAPSIBLE WOODWORKING TABLE

(71) Applicant: Gregory J. Whalen, Rapid City, SD (US)

(72) Inventor: Gregory J. Whalen, Rapid City, SD (US)

( * ) Notice: Subject to any disclaimer, the term of this patent is extended or adjusted under 35 U.S.C. 154(b) by 1070 days.

(21) Appl. No.: 13/684,479

(22) Filed: Nov. 23, 2012

(65) Prior Publication Data

US 2013/0160894 A1 Jun. 27, 2013

Related U.S. Application Data

(60) Provisional application No. 61/562,564, filed on Nov. 22, 2011.

(51) Int. Cl.
*B25B 11/00* (2006.01)
*B25H 1/04* (2006.01)
*B25H 1/14* (2006.01)

(52) U.S. Cl.
CPC . *B25H 1/04* (2013.01); *B25H 1/14* (2013.01)

(58) Field of Classification Search
CPC ..... B25B 1/205; B25B 13/52; B25B 1/14; B23K 37/0533
See application file for complete search history.

(56) References Cited

U.S. PATENT DOCUMENTS

| | | | | |
|---|---|---|---|---|
| 5,924,684 | A * | 7/1999 | Cheng | B25H 1/04 269/139 |
| 6,058,990 | A * | 5/2000 | Kent | B25H 1/10 144/1.1 |
| 6,089,555 | A * | 7/2000 | Lin | B25H 1/04 269/139 |
| 2010/0001450 | A1* | 1/2010 | Marshall | B25H 1/04 269/266 |
| 2012/0205848 | A1* | 8/2012 | Lawrence | B25H 1/04 269/17 |
| 2013/0160894 | A1* | 6/2013 | Whalen | B25H 1/14 144/286.1 |
| 2014/0232053 | A1* | 8/2014 | Lifshitz | B25H 1/02 269/219 |

* cited by examiner

*Primary Examiner* — Lee D Wilson
(74) *Attorney, Agent, or Firm* — Michael A. Bondi; Moss & Barnett

(57) ABSTRACT

A collapsible woodworking that includes a first table portion and a second table portion. The first table portion includes a work piece support surface and a frame assembly. The frame assembly is operably attached to the work piece support surface for movement between an extended position and a retracted position. The second table portion is operably attached to the first table portion. The second table portion includes a work piece support surface and a frame assembly. The frame assembly is operably attached to the work piece support surface for movement between an extended position and retracted position.

19 Claims, 7 Drawing Sheets

COLLAPSIBLE WOODWORKING TABLE

REFERENCE TO RELATED APPLICATION

This application claims priority to U.S. Provisional Application No. 61/562,564, which was filed on Nov. 22, 2011, the contents of which are incorporated herein by reference.

FIELD OF THE INVENTION

The invention relates generally to a device that is used in conjunction with woodworking. More particularly, the invention relates to a collapsible woodworking table.

BACKGROUND OF THE INVENTION

Woodworking can be used to manufacture or assemble various types of objects. Examples of these objects include bookcases, tables, chairs and doors. Two popular tools that are used to cut work pieces into a desired shape and size are table saws and miter saws.

To enable the table saws and miter saws to be used without sitting or kneeling, it is customary to mount the tables saws and miter saws on a table that enables such saws to be used by a person in a standing position.

Depending on the size of the work piece that is being used in conjunction with the table saw or miter saw, it may be necessary for a support to be placed under a portion of the work piece that extends beyond a surface of the table saw or miter saw.

SUMMARY OF THE INVENTION

An embodiment of the invention is directed to a collapsible woodworking table. When collapsed, the woodworking table may be stored in a relatively small area. When setup the collapsible woodworking table provides a surface for supporting work pieces and tools that are used in conjunction with the work pieces.

Another embodiment of the invention is directed to a collapsible woodworking that includes a first table portion and a second table portion. The first table portion includes a work piece support surface and a frame assembly operably attached to the work piece support surface for movement between an extended position and a retracted position.

The second table portion is pivotally attached to the first table portion. The second table portion includes a work piece support surface and a frame assembly operably attached to the work piece support surface for movement between an extended position and retracted position. At least one of the first table portion and the second table portion further includes a side support surface having an upper surface that is substantially aligned with an upper surface of the first table portion and the second table portion to which the saw support frame is attached.

Another embodiment of the invention is directed to a collapsible woodworking that includes a first table portion and a second table portion. The first table portion includes a work piece support surface and a frame assembly operably attached to the work piece support surface for movement between an extended position and a retracted position.

The second table portion is pivotally attached to the first table portion. The second table portion includes a work piece support surface and a frame assembly operably attached to the work piece support surface for movement between an extended position and retracted position. The work piece support surface on the first table portion and the second table portion are both fabricated from a plurality of elongated support pieces that are mounted in a spaced-apart configuration. A spacing between adjacent elongated support pieces is greater than a width of the elongated support pieces.

Another embodiment of the invention is directed to a method of using a collapsible woodworking table. A collapsible woodworking table is provided that includes a first table portion and a second table portion that pivotally mounted with respect to each other. The first table portion with respect to the second table portion from a storage configuration to a use configuration.

A side support surface is operably attached to at least one of the first table portion and the second table portion. The side support surface has an upper surface that is substantially aligned with an upper surface of the first table portion and the second table portion to which the saw support frame is attached.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
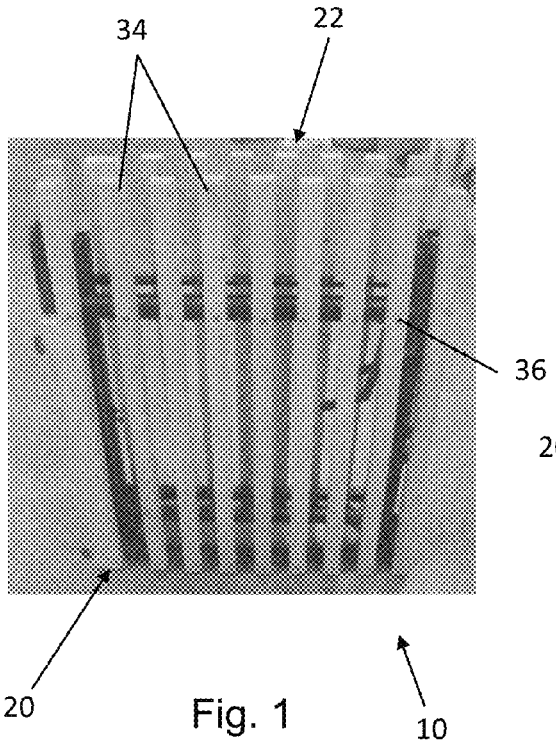
FIG. 1 is a side view of a collapsible woodworking table according to an embodiment of the invention where the collapsible woodworking table is in a storage configuration.
Figure 2:
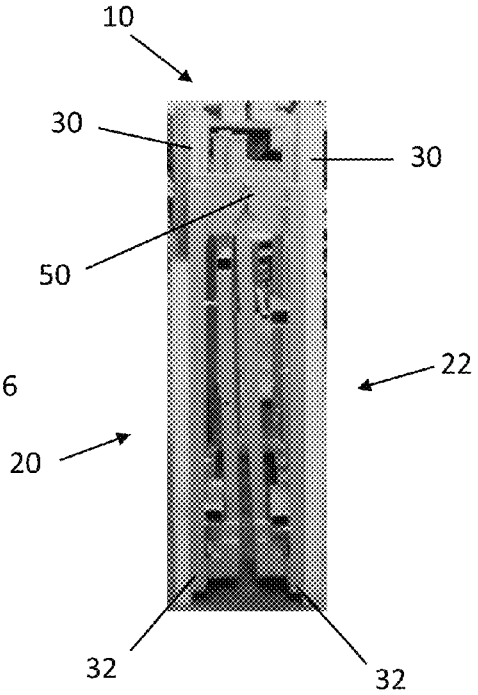
FIG. 2 is an end view of the collapsible woodworking table in the storage configuration.
Figure 3:
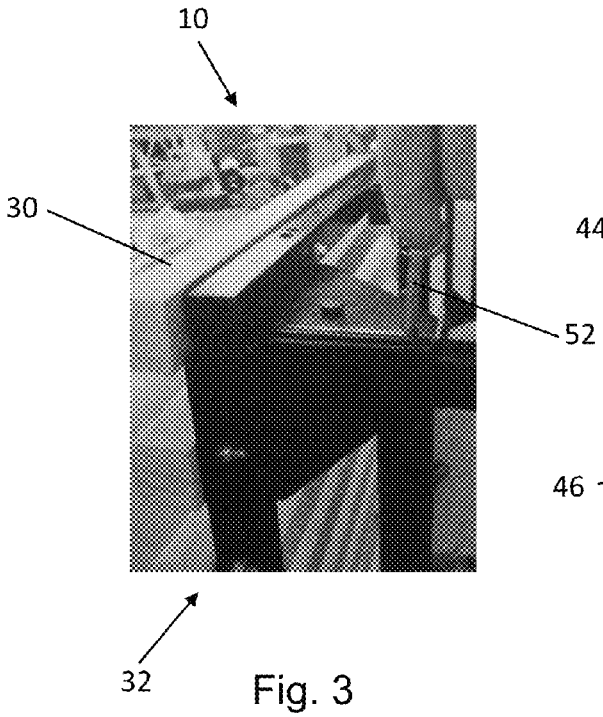
FIG. 3 is a perspective view of a corner of the collapsible woodworking table.
Figure 5:
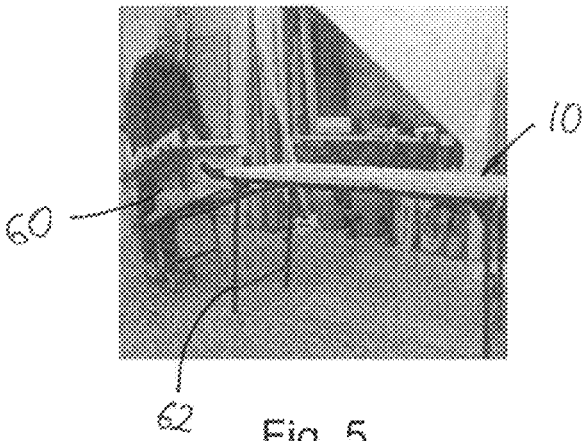
FIG. 5 is a perspective view of a table saw being mounted to the collapsible woodworking table.
Figure 6:
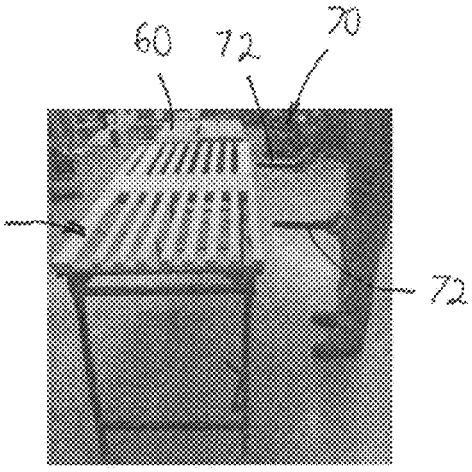
FIG. 6 is a perspective view of the table saw mounted to the collapsible woodworking table and showing an outrigger being attached to the collapsible woodworking table.

An embodiment of the invention is directed to a collapsible woodworking table, as illustrated at 10 in the accompanying figures. The collapsible woodworking table 10 may generally include a first table portion 20 and a second table portion 22 that are pivotally mounted with respect to each other for movement between the storage configuration, which is illustrated in FIGS. 1 and 2, or a use configuration, which is illustrated in FIGS. 5 and 6.

In certain embodiments, the first table portion 20 and the second table portion 22 may each have a length and a width that are substantially equal. In other embodiments, the first table portion 20 and the second table portion 22 may be formed with a different length or width.

When in the use configuration, the collapsible woodworking table 10 may have a width of between about 12 inches and about 48 inches. In other embodiments, the width of the collapsible woodworking table 10 may be between about 24 inches and about 30 inches.

When in the use configuration, the collapsible woodworking table 10 may have a length of between about 50 inches and about 100 inches. In other embodiments, the length of the collapsible woodworking table 10 may be between about 60 inches and about 80 inches.

When in the use configuration, an upper surface of the collapsible woodworking table 10 may have a height of between about 20 inches and about 40 inches. In other embodiments, the height of the upper surface of the collapsible woodworking table 10 may be between about 30 inches and about 35 inches to facilitate use of the collapsible woodworking table 10 by a person in a standing configuration.

When in the storage configuration, the collapsible woodworking table 10 may have a length that is about one-half of the length of the collapsible woodworking table 10 in the use configuration. When in the storage configuration, the collapsible woodworking table 10 may have a thickness of less than about 10 inches. Such a configuration facilitates storage of the collapsible woodworking table 10 in a relatively small space.

The first table portion 20 and the second table portion 22 may each include a work piece support surface 30 and a frame assembly 32. The work piece support surface 30 may be fabricated from a plurality of elongated support pieces 34.

Figure 18:
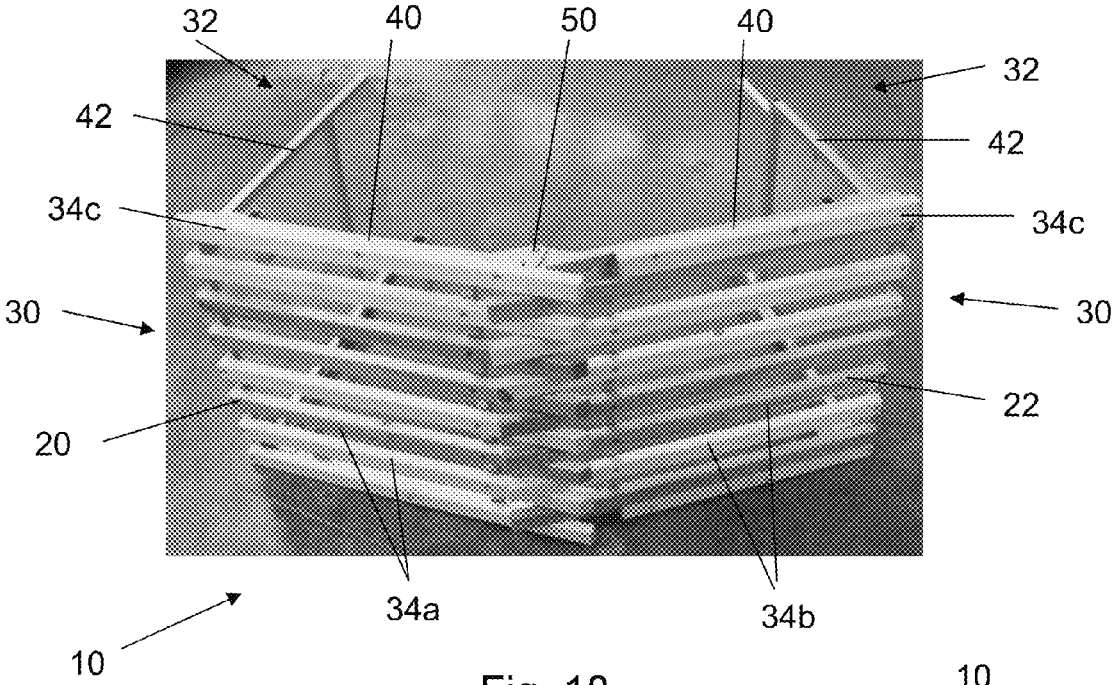
FIG. 18 is a top view of the collapsible woodworking table with the first table portion partially bent with respect to the second table portion.

In one embodiment, the elongated support pieces 34 are mounted in a spaced-apart configuration. The spacing between the elongated support pieces 34 may be slightly larger than the width of the elongated support pieces 34. Elongated support pieces 34*a* on the first table portion 20 are offset from elongated support pieces 34*b* on the second table portion 22, as illustrated in FIGS. 1, 6 and 18. Using this configuration enables the ends of the elongated support pieces 34*a*, 34*b* proximate the intersection of first table portion 20 and the second table portion 22 to be positioned between each other as the collapsible woodworking table 10 is moved to the use configuration, as illustrated in FIGS. 6 and 18.

The elongated support pieces 34 may be formed with dimensions that provide the elongated support pieces 34 with sufficient strength so that it is not necessary to provide intermediate supports beneath the elongated support pieces 34. In certain embodiments, the elongated support pieces 34 may have a height and a width of between about 1 inch and about 2 inches.

The elongated support pieces 34*c* on at least one of the edges of the collapsible woodworking table 10 may not be offset, as illustrated in FIG. 18. Using such a configuration provides a single edge that extends the length of the collapsible woodworking table 10.

The upper surface of the elongated support pieces 34 may be sufficiently durable to resists degradation during use as well as minimizing the potential of damage to the work pieces that are placed on the collapsible woodworking table. The elongated support pieces 34 may be fabricated from a variety of materials using the concepts of the invention. Examples of suitable materials include wood, metal and plastic.

A potential benefit of using wood for the elongated support pieces 34 is that if a saw that is being used on the work pieces cuts into the elongated support pieces 34, the saw blade will not be damaged. If the cut is too deep, the elongated support piece 34 may be weakened to an extent that it is desirable to replace it.

The elongated support pieces 34 may be attached to the frame assembly 32 using a variety of techniques. An example of one suitable fastening mechanism 36 is a screw that facilitates replacement of the elongated support pieces 34 that are damaged.

The frame assembly 32 may include an upper frame portion 40 and a leg portion 42. The upper frame portion 40 may include a pair of side members 44 and at least one cross member 46 that extends between the side members.

The upper frame portion 40 thereby provides a support to which the elongated support pieces 34 are attached. The side members 44 and the at least one cross member 46 may be fabricated from a variety of materials that provide the upper frame portion 40 with sufficient rigidity so that the upper frame portion 40 resists deformation and breakage during the use of the collapsible woodworking table 10. Examples of materials that may be used to fabricate the upper frame portion 40 include wood, metal and plastic.

In one embodiment, the cross member 46 has a generally cylindrical configuration. The cross member 46 may be used for attaching other objects to the collapsible woodworking table 10, as is discussed in more detail below.

Proximate a first end of the upper frame portion 40, at least one hinge mechanism 50 is provided to pivotally attach the first table section 20 and the second table section 22. The hinge mechanism 50 may include a lock that prevents the hinge mechanism 50 from pivoting when the collapsible woodworking table 10 is in the storage configuration or the use configuration.

The leg portion 42 may be operably attached to the upper frame portion 40 to facilitate moving the leg portion 42 from a use configuration that is substantially perpendicular to the upper frame portion 40 to a storage configuration that is substantially perpendicular to the upper frame portion 40. In one such configuration, the leg portion 42 is pivotally mounted to the upper frame portion 40.

In another embodiment of the invention, at least one of the leg portions 42 has an adjustable length. Providing the leg portion 42 with the adjustable length enables the height of the work piece support surface to be adjusted.

A lock mechanism such as a pin 52 may be provided to prevent the leg portion 42 from pivoting with respect to the upper frame portion 40 except when the pin is detached therefrom. The lock mechanism may be used to retain the leg portion 42 in the use configuration as well as in the storage configuration.

Figure 19:
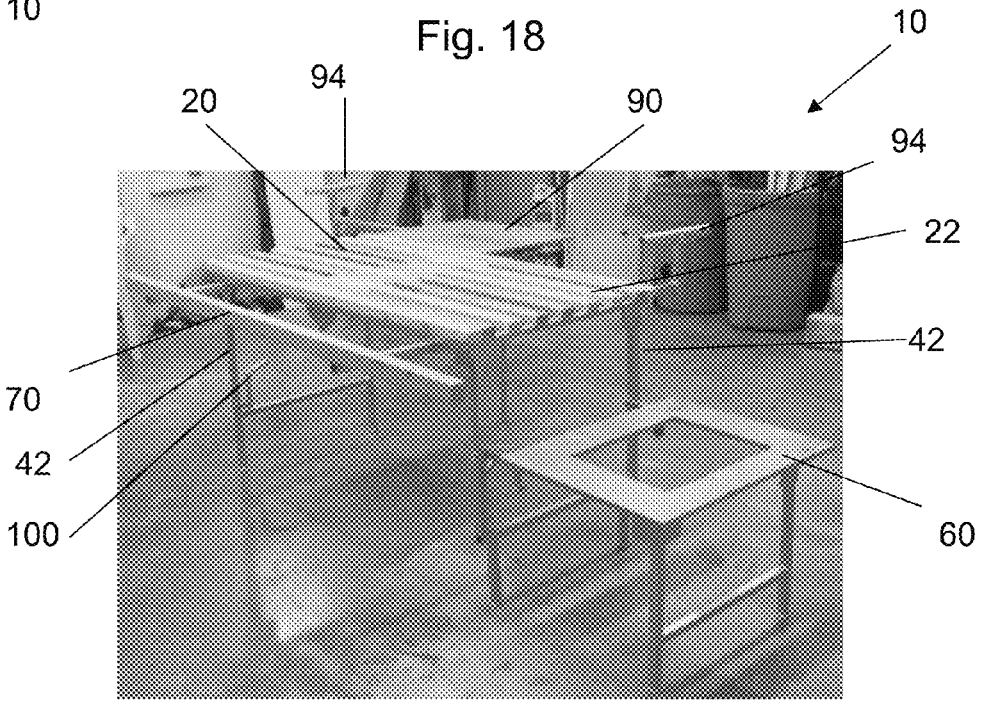
FIG. 19 is a perspective view of the collapsible woodworking table in an assembled configuration.
Figure 20:
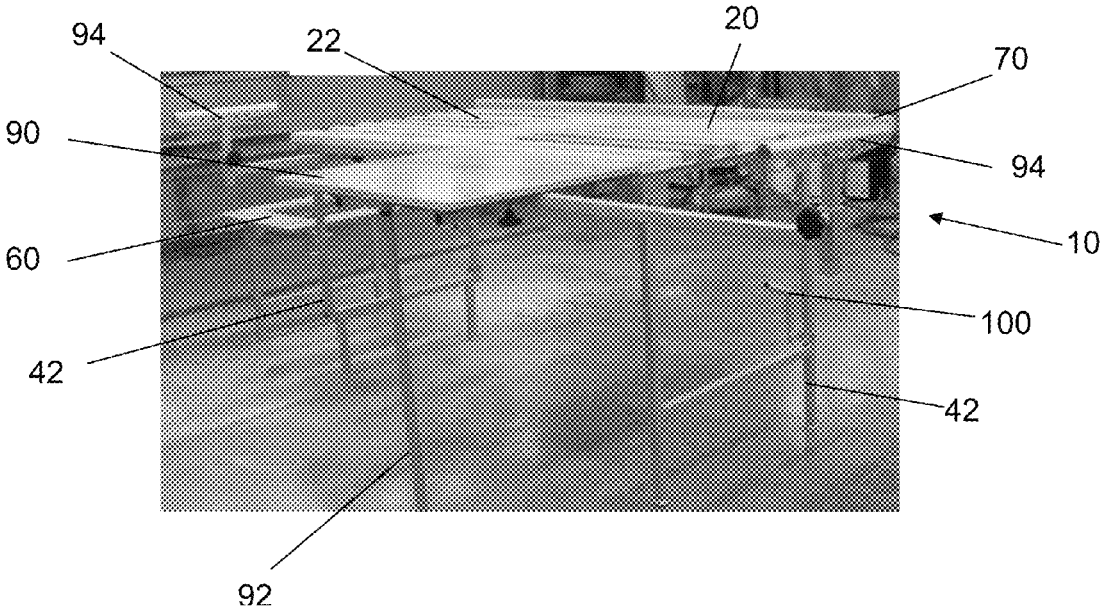
FIG. 20 is another perspective view of the collapsible woodworking table in the assembled configuration.
Figure 21:
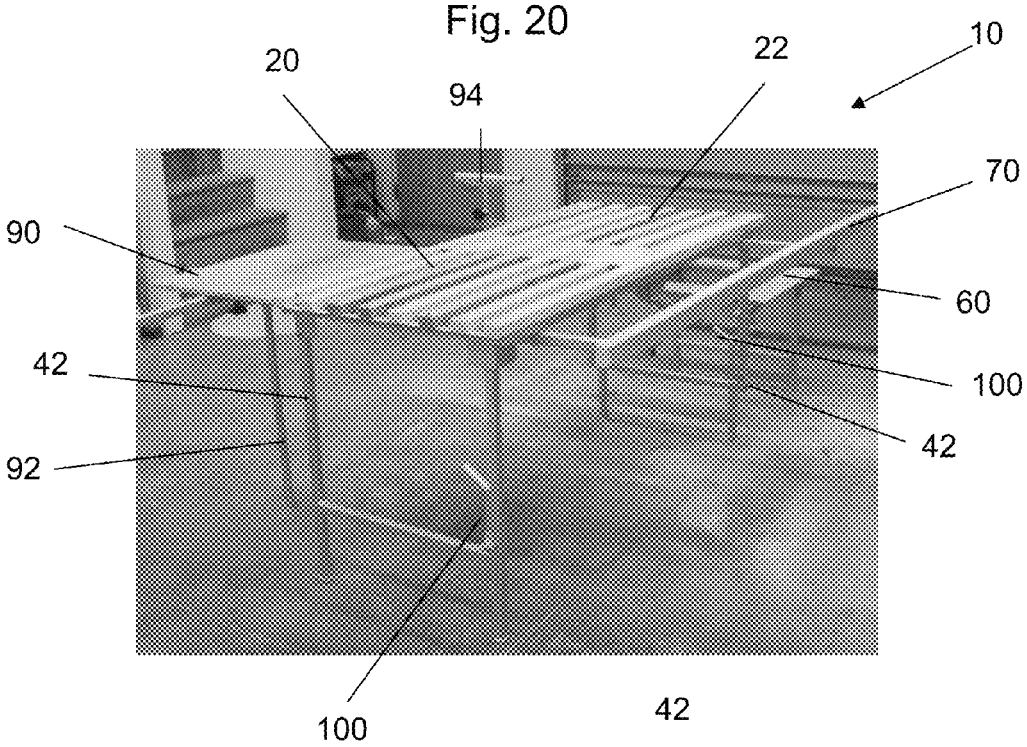
FIG. 21 is another perspective view of the collapsible woodworking table in the assembled configuration.

Various views of the collapsible woodworking table 10 are illustrated in FIGS. 19-21. These views illustrate addition components attached to the collapsible woodworking table 10, which are discussed below.

When it is desired to use the collapsible woodworking table 10 in conjunction with a table saw 60, the table saw 60 is mounted on a saw support frame 62, which provides an upper surface of the table saw 60 at approximately the same height as the upper surface of the collapsible woodworking table 10.

The saw support frame 62 may engage a portion of the collapsible woodworking table 10 so that the table saw 60 resists movement with respect to the collapsible woodworking table 10 during use. An example of one technique that may be used to attach the saw support frame 62 to the collapsible woodworking table 10 is a clamp.

In one such configuration, the table saw 60 may be mounted proximate to an end of the collapsible support table 10 so that the collapsible support table 10 can support work pieces before or after the work pieces are cut with the table saw.

As an alternative to mounting the table saw 60 to the saw support frame 62, it is possible to attach other woodworking tools to the saw support frame 62. An example of one such alternative woodworking tool is a router.

When it is desired to support a work piece having a width that is significantly more than the width of the collapsible support table 10, an outrigger assembly 70 may be attached to the collapsible woodworking table 10. The outrigger assembly 70 may include at least one extension piece 72 and at least one outrigger support 74.

The extension piece 72 may have an elongated configuration that is formed with a length that depends on the width of the work piece that is desired to be supported on the collapsible woodworking table 10. In certain embodiments, the extension piece has a length of between about 6 inches and about 18 inches.

Figure 4:
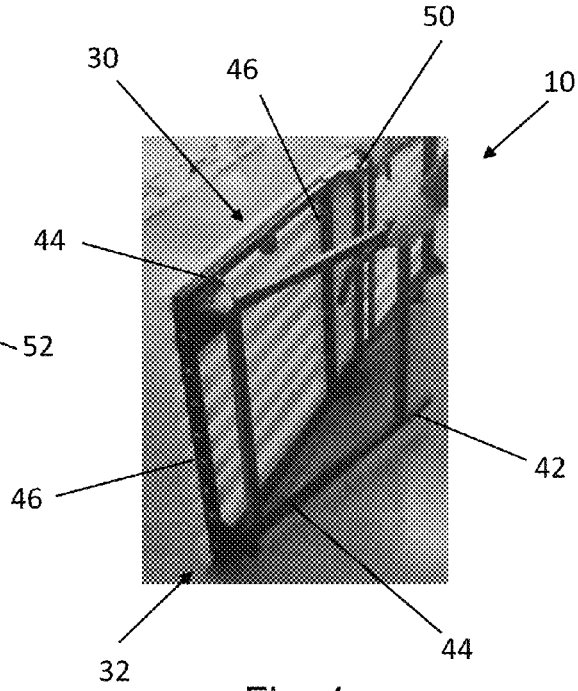
FIG. 4 is a perspective view showing folding a leg portion to the storage configuration.
Figure 7:
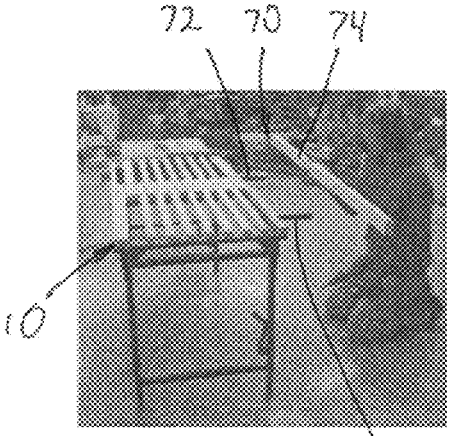
FIG. 7 is a perspective view of a support member attached to two of the outriggers.

The extension piece 72 engages an adapter 76 that is attached to the upper frame portion 40, as illustrated in FIGS. 4 and 6. Thereafter, the outrigger support 74 may be attached to the extension piece 72, as illustrated in FIG. 7. A variety of techniques may be used to attach the outrigger support 74 to the extension piece 72. An example of one such technique is a screw.

Figure 8:
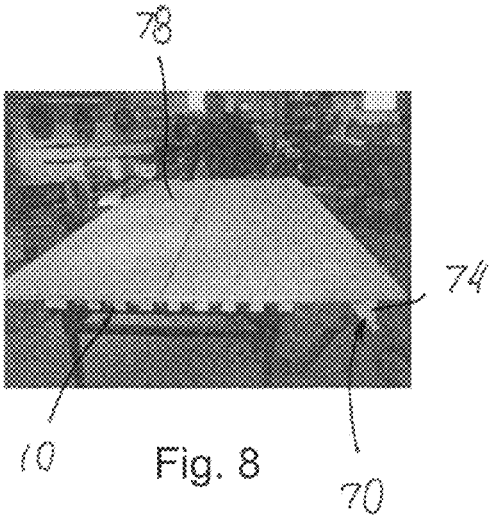
FIG. 8 is a perspective view of the collapsible woodworking table and the outrigger assembly supporting an object having a width that is greater than a width of the collapsible woodworking table.

After the outrigger assembly 70 is attached to the collapsible woodworking table 10, a work piece 78 having a width that is greater than the width of the collapsible woodworking table 10 may be supported on the collapsible woodworking table 10, as illustrated in FIG. 8.

Figure 9:
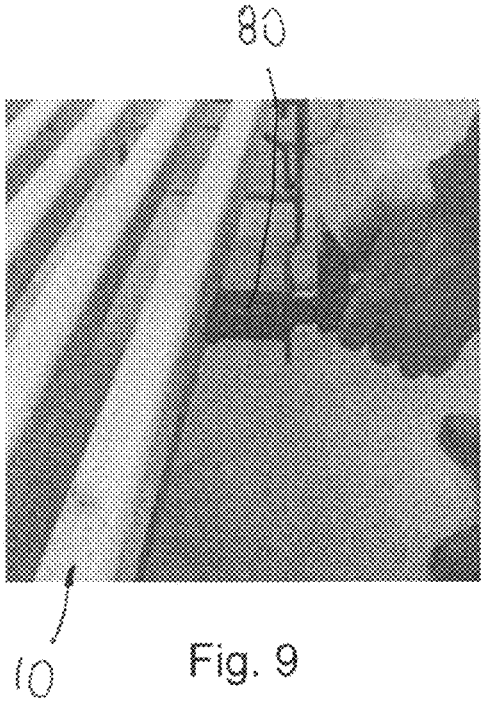
FIG. 9 is a perspective view of a clamp mounted to the collapsible woodworking table.
Figure 10:
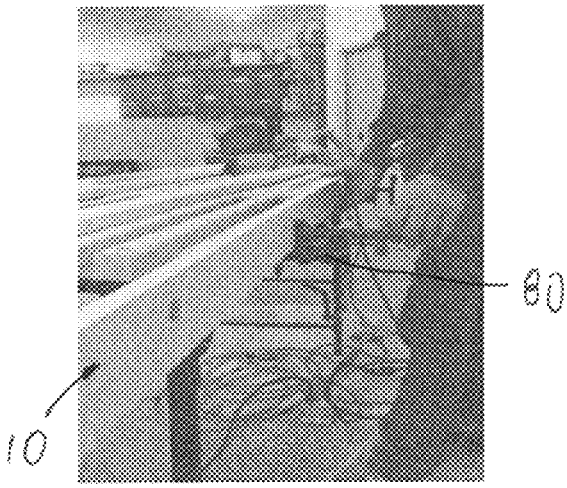
FIG. 10 is a perspective view of the clamp used to attach a work piece with respect to the collapsible woodworking table.

A clamping mechanism 80 may be attached to at least one of the side of the collapsible woodworking table 10, as illustrated in FIGS. 9 and 10. The clamping mechanism 80 may take a variety of forms and may be used to secure the work piece either to the upper surface of the collapsible woodworking table 10 or to a side of the collapsible woodworking table 10.

Figure 11:
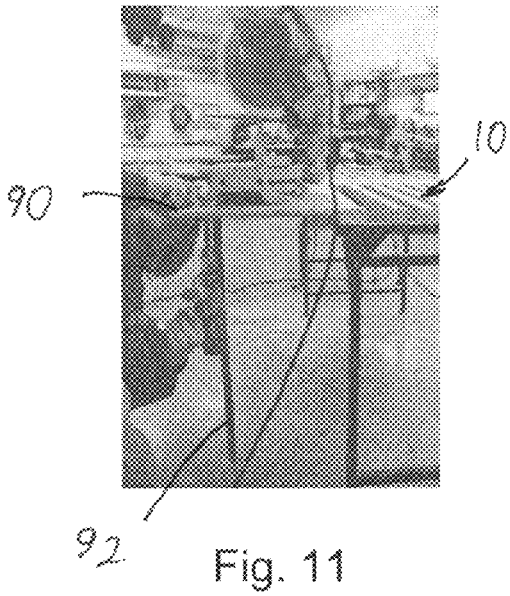
FIG. 11 is a perspective view of a side table mounted to the collapsible woodworking table.

A side support table 90 may also be used in conjunction with the collapsible woodworking table 10, as illustrated in FIG. 11. The side support table 90 may be formed with a length and a width that is sufficiently large to support a woodworking tool such as a miter saw.

While not illustrated, the side support table 90 may be configured so that a surface of the woodworking tool on which the work piece is placed has a height that is approximately the same as the upper surface of the collapsible woodworking table 10.

In one configuration, the side support table 90 attaches to a side of the collapsible woodworking table 10. A variety of techniques may be used to attach the side support table 90 to the collapsible woodworking table 10.

A side support leg 92 may extend from a lower surface of the side support table 90 to provide additional support for the woodworking tool placed on the side support table 90. The side support leg 92 extends to the ground surface adjacent to the collapsible woodworking table 10. The side support leg 92 may be formed with an adjustable length.

Figure 12:
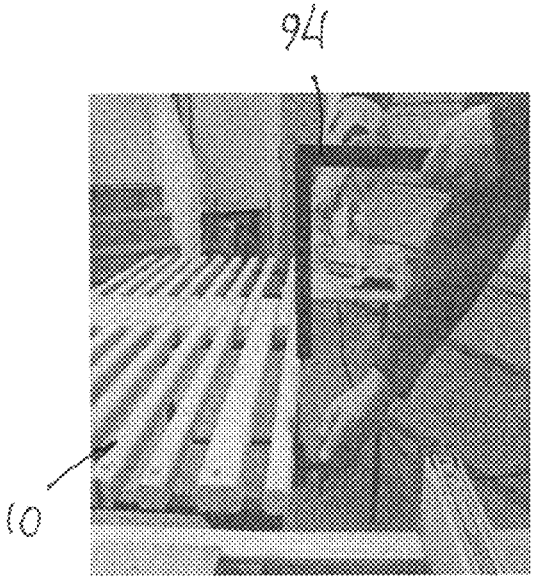
FIG. 12 is a perspective view of a work piece support being mounted to the collapsible woodworking table that is used in conjunction with a saw on the side table.

A side work piece support 94, which is illustrated in FIG. 12, may be used in conjunction with the woodworking tool to support an end of the work piece that is being cut with the woodworking tool. The side work piece support 94 may be attached to an end of the collapsible woodworking table 10 that is opposite the end of the collapsible woodworking table 10 to which the side support table 90 is attached.

The attachment of the side work piece support 94 may enable a height of the side work piece support 94 to be varied depending on the height of the surface of the woodworking tool on which the work piece is placed.

Figure 13:
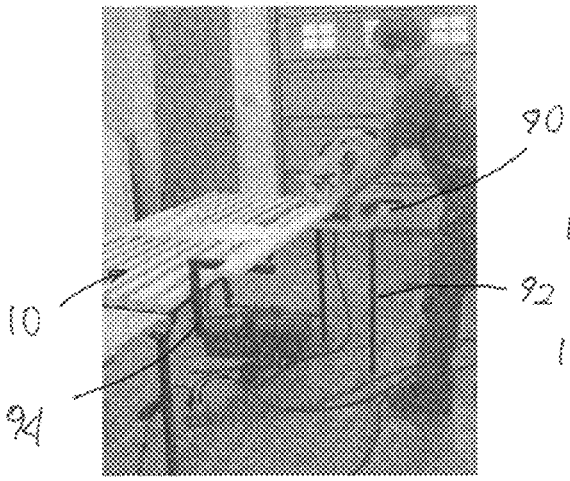
FIG. 13 is a perspective view of the work piece support being used in conjunction with the saw on the side table when a work piece is being cut with the saw.

The side support table 90 and the side work piece support 94 thereby enable the woodworking tool to be used in conjunction with a work piece, as illustrated in FIG. 13, without affecting the ability to place other work pieces on the upper surface of the collapsible woodworking table.

A door support 100 may be mounted to the leg portions 42 on at least one side of the collapsible woodworking table 10. The door support 100 may include a first support section 102 and a second support section 104.

The first support section 102 is pivotally attached to the leg portion 42. The second support section 104 is attached to an end of the first support section 102 that is opposite the leg portion 42. The second support section 104 is oriented at an obtuse angle with respect to the first support section 102. The second support section 104 thereby prevents the work piece from sliding off of the first support section 102.

Figure 14:
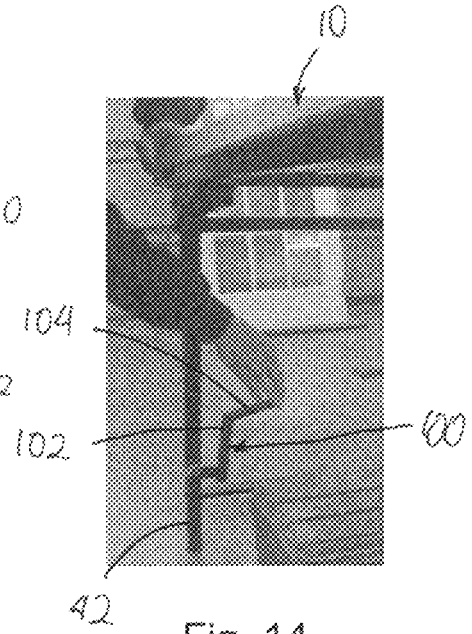
FIG. 14 is a perspective view of a door support attached to the collapsible woodworking table where the door support is in a retracted configuration.
Figure 15:
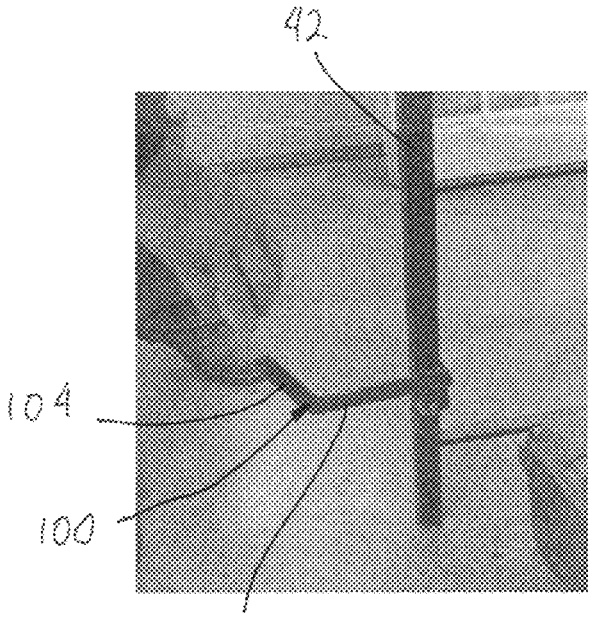
FIG. 15 is a perspective view of the door support in an extended configuration.
Figure 16:
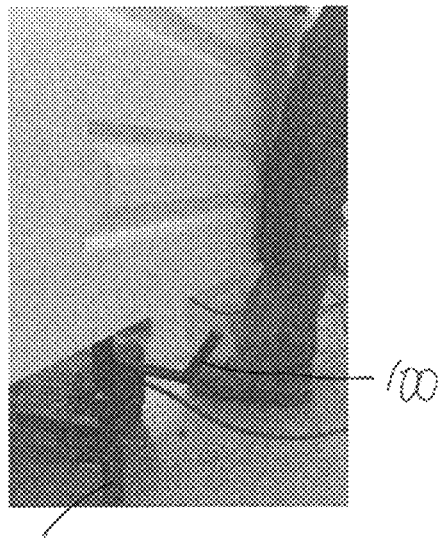
FIG. 16 is a perspective view of the door support used to support a first object adjacent to a first side of the collapsible woodworking table.

The door support 100 may initially be positioned in a retracted position, as illustrated in FIG. 14, where the door support 100 does not extend beyond the side of the collapsible woodworking table 10. When the door support 100 is pivoted to a use position, as illustrated in FIG. 15, the first support section 102 may be oriented substantially horizontal.

Figure 17:
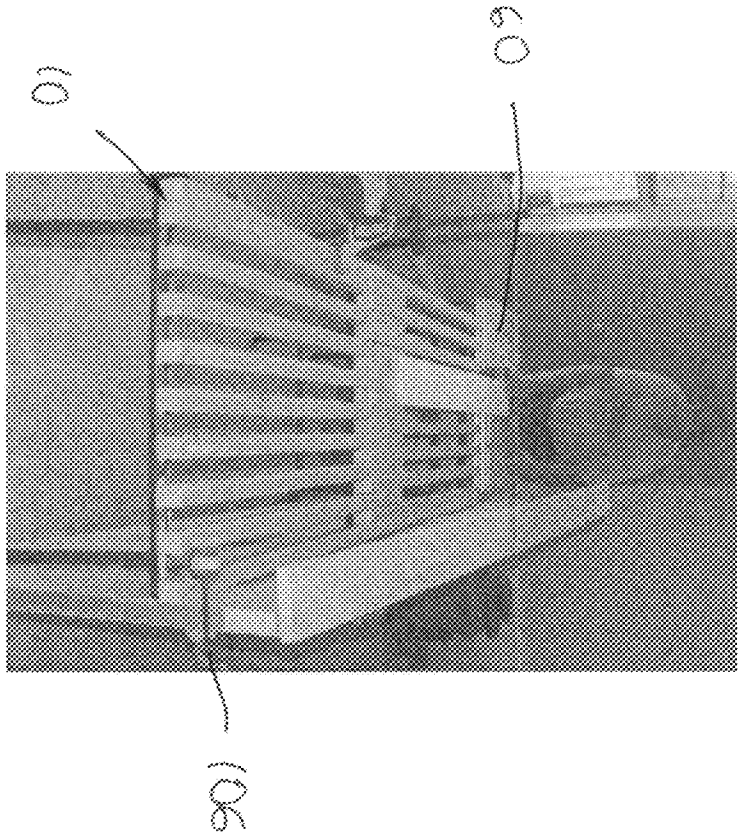
FIG. 17 is a perspective view of the first object mounted to the first side of the collapsible woodworking table where the table saw is used to cut a second object.

Thereafter, the work piece may be supported on the door support 100. A clamp 106 may be used to mount an upper edge of the work piece to an upper portion of the collapsible woodworking table 10, as illustrated in FIG. 17.

The attachment of the work piece to the collapsible woodworking table 10 thereby mounts the work piece at a desirable height for processing by a worker in a standing position while leaving the upper surface of the collapsible woodworking table 10 open for performing other woodworking tasks. For example, the table saw may be used for cuts such as ripping a door jamb. The mounting also enhances the ability to accurate use a router on the door where the hinges are to be received.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A collapsible woodworking comprising:

a first table portion comprising:

a work piece support surface; and a frame assembly operably attached to the work piece support surface for movement between an extended position and a retracted position;

a second table portion comprising:

a work piece support surface; and a frame assembly operably attached to the work piece support surface for movement between an extended position and retracted position, wherein the frame assembly of the first table portion is pivotally attached to the frame assembly of the second table portion;

a side support surface attached to at least one of the first table portion and the second table portion, wherein the side support surface has an upper surface that is substantially aligned with an upper surface of the first table portion and the second table portion to which the side support frame is attached.

2. The collapsible woodworking table of claim 1, wherein the side support frame is slidably mounted to at least one of the first table portion and the second table portion.

3. The collapsible woodworking table of claim 1, wherein the side support frame further comprises:

a frame assembly operably attached to the side support surface and the frame assembly on at least one of the first table portion and the second table portion.

4. The collapsible woodworking table of claim 1, and further comprising an end support frame that comprises:

an end support surface having an upper surface height that is lower than an upper surface height of the first table portion and the second table portion to which the saw support frame is attached; and an end frame assembly operably attached to the end support surface and the frame assembly on at least one of the first table portion and the second table portion.

5. The collapsible woodworking table of claim 1, and further comprising at least one door support mounted at an intermediate location on the frame assembly, wherein the door support comprises:

a first door support section pivotally mounted to the frame assembly for movement between a retracted position and an extended position; and a second door support section mounted to the first door support section opposite the frame assembly, wherein the second door support section is oriented at an obtuse angle with respect to the first door support section.

6. The collapsible woodworking table of claim 1, and further comprising a clamping mechanism mounted with respect to at least one of the first table portion and the second table portion.

7. The collapsible woodworking table of claim 1, wherein the frame assembly on the first table portion and the second table portion each comprise:

an upper frame portion to which the work piece support surface is mounted, wherein the upper frame portion comprises:

a pair of side members; and at least one cross member that extends between the side members, wherein the side members on the first table portion are pivotally attached to the side members on the second table portion; and a leg portion that is operably mounted to the upper frame portion from movement between the use configuration and the storage configuration.

8. The collapsible woodworking table of claim 7, and further comprising:

at least one hinge mechanism that pivotally attaches the upper frame portion on the first table portion to the upper frame portion on the second table portion; and a lock mechanism that selectively prevents the at least one hinge mechanism from pivoting.

9. The collapsible woodworking table of claim 7, wherein the leg portion is pivotally attached to the upper frame portion and wherein the collapsible woodworking table further comprises a lock mechanism for selectively preventing the leg portion from pivoting with respect to the upper frame portion.

10. The collapsible woodworking table of claim 7, wherein the cross member has an aperture formed therein and wherein the collapsible woodworking table further comprises a side support surface having an extension that slidably engages the cross member through the aperture.

11. A collapsible woodworking comprising:

a first table portion comprising:

a work piece support surface; and a frame assembly operably attached to the work piece support surface for movement between an extended position and a retracted position;

a second table portion, wherein the second table portion comprises:

a work piece support surface; and a frame assembly operably attached to the work piece support surface for movement between an extended position and retracted position, wherein the frame assembly of the first table portion is pivotally attached to the frame assembly of the second table portion, wherein the work piece support surface on the first table portion and the second table portion are both fabricated from a plurality of elongated support pieces that are mounted in a spaced-apart configuration and wherein a spacing between adjacent elongated support pieces is greater than a width of the elongated support pieces; and wherein the frame assembly on the first table portion and the second table portion each comprise:

an upper frame portion to which the work piece support surface is mounted, wherein the upper frame portion comprises:

a pair of side members; and at least one cross member that extends between the side members, wherein the side members on the first table portion are pivotally attached to the side members on the second table portion; and a leg portion that is operably mounted to the upper frame portion from movement between the use configuration and the storage configuration.

12. The collapsible woodworking table of claim 11, wherein the elongated pieces on the first table portion and the second table portion each comprise:

a central plurality of elongated pieces, wherein the central plurality of elongated pieces on the first table portion are offset from the central plurality of elongated pieces on the second table portion; and an edge elongated piece, wherein the edge elongated piece on the first table portion is aligned with the edge elongated piece on the second table portion.

13. The collapsible woodworking table of claim 11, and further comprising:

at least one hinge mechanism that pivotally attaches the upper frame portion on the first table portion to the upper frame portion on the second table portion; and a lock mechanism that selectively prevents the at least one hinge mechanism from pivoting.

14. The collapsible woodworking table of claim 11, wherein the leg portion is pivotally attached to the upper frame portion and wherein the collapsible woodworking table further comprises a lock mechanism for selectively preventing the leg portion from pivoting with respect to the upper frame portion.

15. The collapsible woodworking table of claim 11, wherein the cross member has an aperture formed therein and wherein the collapsible woodworking table further comprises a side support surface having an extension that slidably engages the cross member through the aperture.

16. A method of using a collapsible woodworking table comprising:

providing a collapsible woodworking table having a first table portion and a second table, wherein the first table portion and the second table portion each comprise a work piece support surface and a frame assembly operably attached to the work piece support surface, wherein the frame assembly of the first table portion is pivotally attached to the frame assembly of the second table portion;

pivoting the first table portion with respect to the second table portion from a storage configuration to a use configuration;

moving the frame assembly on the first table portion and the second table portion from a retracted position to an extended position; and operably attaching a side support surface to at least one of the first table portion and the second table portion, wherein the side support surface has an upper surface that is substantially aligned with an upper surface of the first table portion and the second table portion to which the saw support frame is attached.

17. The method of claim 16, wherein the side support frame is slidably mounted to the at least one of the first table portion and the second table portion.

18. The method of claim 16, and further comprising operably attaching a frame assembly to the side support surface and the frame assembly on at least one of the first table portion and the second table portion.

19. The method of claim 16, and further comprising operably attaching at least one door support mounted at an intermediate location on the frame assembly of at least one of the first table portion and the second table portion, wherein the door support comprises a first door support section and a second door support section, wherein the first door support section pivotally is mounted to the frame assembly for movement between a retracted position and an extended position, wherein the second door support section is mounted to the first door support section opposite the frame assembly and wherein the second door support section is oriented at an obtuse angle with respect to the first door support section.

* * * * *